US007632055B2

(12) United States Patent
Foroni

(10) Patent No.: US 7,632,055 B2
(45) Date of Patent: Dec. 15, 2009

(54) FORK-LIFT ATTACHMENT WITH MULTIPLE FORKS

(75) Inventor: Pietro Foroni, Casalpusterlengo (IT)

(73) Assignee: Bolzoni S.p.a., Casoni di Podenzano (IT)

( * ) Notice: Subject to any disclaimer, the term of this patent is extended or adjusted under 35 U.S.C. 154(b) by 137 days.

(21) Appl. No.: 11/543,243

(22) Filed: Oct. 5, 2006

(65) Prior Publication Data

US 2007/0079558 A1 Apr. 12, 2007

(30) Foreign Application Priority Data

Oct. 11, 2005 (IT) ..... MO2005A0260

(51) Int. Cl.
*B66F 9/14* (2006.01)

(52) U.S. Cl. ..... 414/667; 414/671; 384/26; 384/35

(58) Field of Classification Search ..... 414/667, 414/671; 187/222–238; 37/232, 234–236; 111/66–68; 258/11–14, 21–26; 483/25–26; 211/162; 294/119.1; 384/26, 35; *B66F 9/14*
See application file for complete search history.

(56) References Cited

U.S. PATENT DOCUMENTS

| | | | | |
|---|---|---|---|---|
| 3,387,731 | A * | 6/1968 | Gibson et. al. | 414/639 |
| 4,185,944 | A * | 1/1980 | Seaberg | 414/621 |
| 4,279,564 | A * | 7/1981 | Weinert | 414/667 |
| 4,533,290 | A * | 8/1985 | Hackauf | 414/667 |
| 5,096,363 | A * | 3/1992 | Weinert et al. | 414/667 |
| 5,139,385 | A * | 8/1992 | Chase et al. | 414/667 |
| 5,336,039 | A * | 8/1994 | House | 414/621 |
| 5,392,538 | A * | 2/1995 | Geerligs et al. | 37/268 |
| 2004/0096129 | A1 * | 5/2004 | Schmalzhofer | 384/42 |

FOREIGN PATENT DOCUMENTS

| | | | |
|---|---|---|---|
| DE | 19953970 | A1 * | 5/2001 |
| DE | 10154842 | A1 * | 5/2003 |
| DE | 10216630 | C1 * | 7/2003 |
| EP | 355668 | A1 * | 2/1990 |

* cited by examiner

*Primary Examiner*—Paul T Chin
*Assistant Examiner*—Jonathan D Snelting
(74) *Attorney, Agent, or Firm*—Nixon & Vanderhye P.C.

(57) ABSTRACT

An apparatus for providing with two pairs of forks a front part of a forklift truck comprises first profiled elements for supporting a pair of external forks and second profiled elements for supporting a pair of internal forks, a guide device that receives internally both said first profiled elements and said second profiled elements.

9 Claims, 2 Drawing Sheets

FORK-LIFT ATTACHMENT WITH MULTIPLE FORKS

CROSS REFERENCE TO RELATED APPLICATION

This application is a new U.S. utility application claiming benefit of IT MO2005A000260 filed Oct. 11, 2005, the entire contents of which are hereby incorporated by reference.

The invention relates to an apparatus, in particular for forks of forklift trucks.

BACKGROUND OF THE INVENTION

Prior art comprises an apparatus for moving the forks of forklift trucks, comprising a fixed frame that in use is mounted on the front part of a forklift truck and which has distinct pairs of guides on which respective pads slide on which the forks are mounted. In particular, a pair of guides is provided for the pads of the more external pair of guides and a further pair of guides for the pads of the more internal pair of guides.

Apparatuses are further known in which the external forks are mounted on profiled elements that act as a guide and support for internal forks or, —viceversa—in which the internal forks are mounted on profiled elements that act as a guide or support for the external forks.

Prior-art apparatuses have the drawback of having a certain overall dimensions in height or depth and, therefore, such apparatuses considerably limit the working zone visible for an operator sitting on the forklift truck.

Therefore, an object of the invention is to improve known apparatuses.

A further object is to find an apparatus for auxiliary tools of forklift trucks that provides better visibility of the work zone.

BRIEF DESCRIPTION OF THE DRAWINGS

The invention can be better understood and implemented with reference to the attached drawings, that show an embodiment thereof by way of non-limiting example, in which.

DESCRIPTION OF THE INVENTION

According to the invention, there is provided an apparatus, comprising first profiled elements for supporting a pair of external forks and second profiled elements for supporting a pair of internal forks, a guide device for guiding said first profiled elements and said second profiled elements, characterised in that said guide device receives both said first profiled elements and said second profiled elements. Owing to the invention, it is possible to obtain an overall height of the forklift truck that is much less than that of known apparatuses.

In fact, the guide device is common to the first and to the second profiled elements and therefore the structure of the guide device is very compact.

Figure 1:
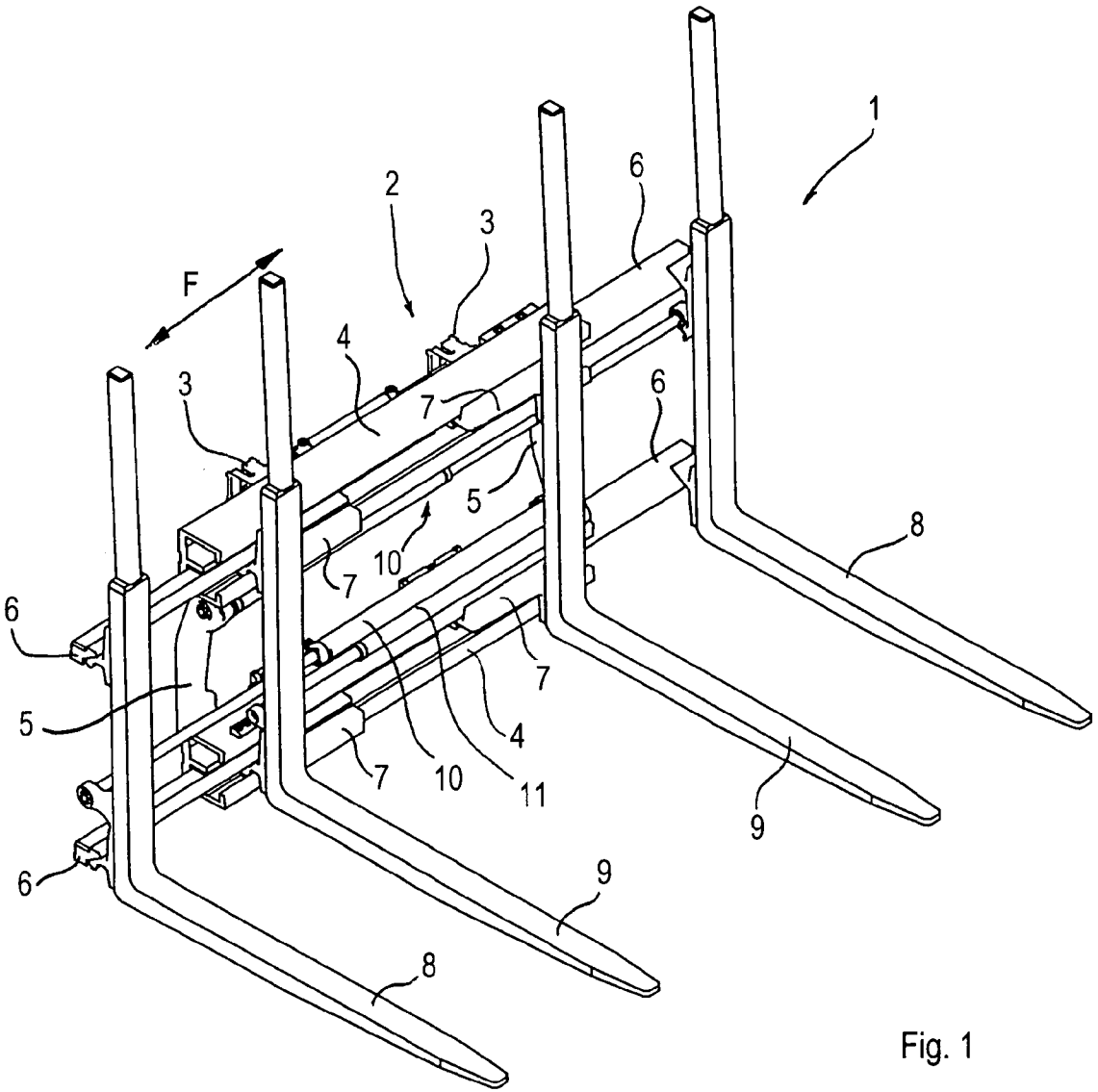
FIG. 1 is a perspective view of an apparatus for forklift trucks on which two pairs of forks are mounted.

As shown in FIG. 1, an apparatus 1 comprises a frame 2 that is mountable on the front part of a forklift truck by means of a suitable fixing device 3. The frame 2 is formed by a pair of crosspieces 4, which are parallel to one another and in use generally lie parallel to the ground, the crosspieces 4 being connected together by means of a pair of uprights 5.

Each crosspiece 4 is formed by an internally hollow profiled body for receiving first profiled elements 6 and second profiled elements 7.

The first profiled elements 6 are divided into two pairs that occupy corresponding and opposite longitudinal zones of the crosspieces 4, on each pair of the first profiled elements 6 there being mounted an external fork 8 of a pair of external forks.

The second profiled elements 7 are also divided into two pairs that occupy corresponding and opposite longitudinal zones of the crosspieces 4, on each pair of the second profiled elements 7 there being mounted an internal fork 9 of a pair of internal forks.

Between each external fork 8 and the frame 2 there is mounted a hydraulic actuator 10 that enables each external fork 8 to be moved from an extended position further from the frame 2 to a retracted position nearer the frame 2, and vice-versa.

Between each internal fork 9 and the frame 2 there is mounted a gas spring 11 by means of which each internal fork 9 is movable along the crosspieces 4 to follow the movements of the respective external fork 8 that are caused by the actuator 10, as explained above.

Furthermore, the frame 2 can be moved sideways with respect to the forklift truck along the direction indicated by the arrow F, with the aid of known movement devices.

Figure 2:
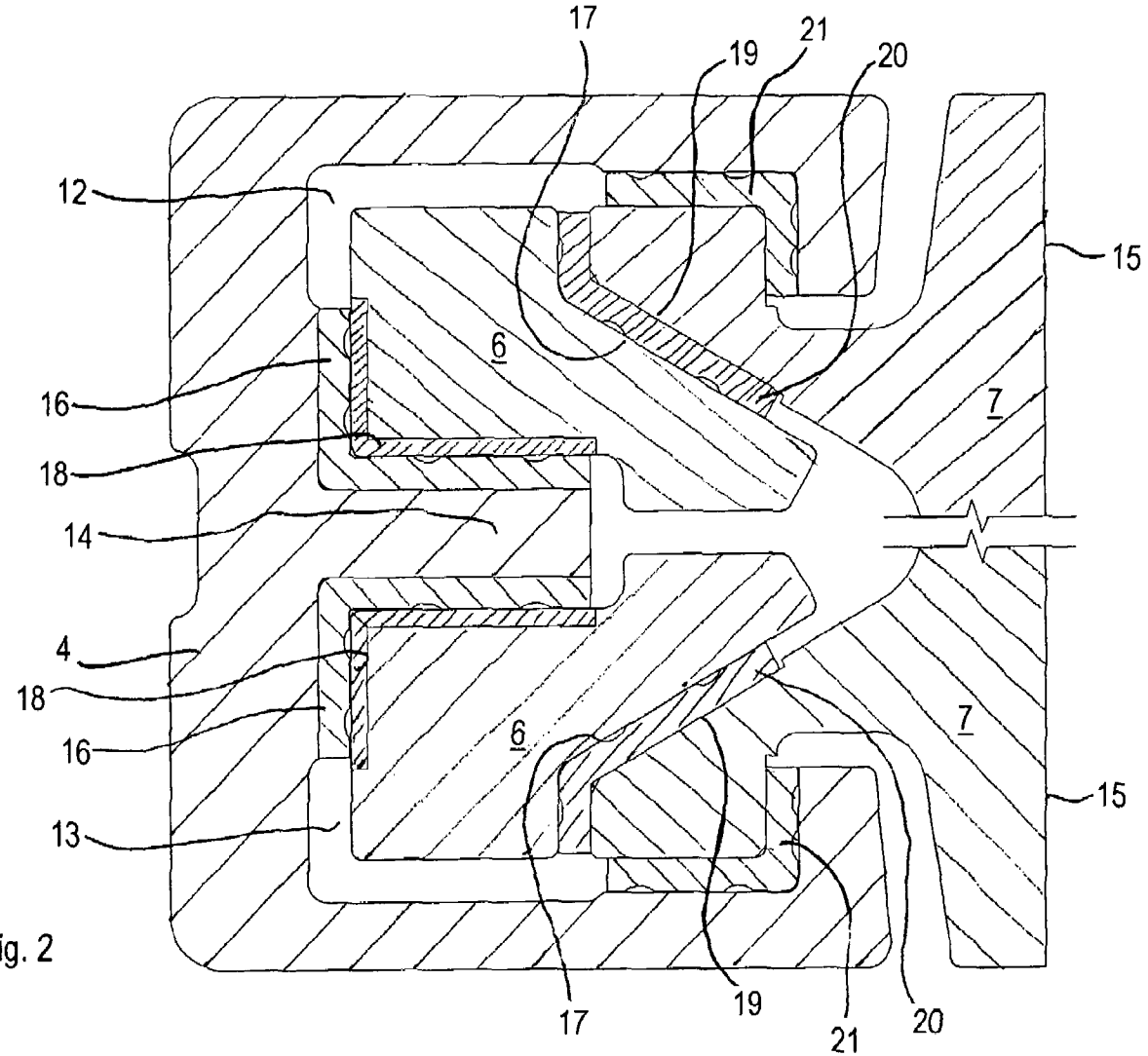
FIG. 2 is a cross section of the guide device of the apparatus in FIG. 1.

As shown in greater detail in FIG. 2, each crosspiece 4 has a substantially "E"-shaped cross section and has a first chamber 12 and a second chamber 13 between which there is interposed a rib 14. In each chamber 12, 13 there are slidingly received, at both the longitudinal portions of each crosspiece 4, both the first profiled elements 6 and the second profiled elements 7, the latter being provided in the face further from the crosspieces 4 with coupling surfaces 15 on which the internal forks 9 are mountable. The first profiled elements 6 and the second profiled elements 7 have respective conjugated cross sections, i.e. such shaped as to substantially occupy each of the chambers 12, 13 in such a way as to form an assembly of slidable parts sliding on one another along the longitudinally extending direction of each crosspiece 4. More in particular, the first profiled elements 6 have a right edge 18 coupled by means of a first sliding pad 16 with a zone of the chamber 12, 13 near the rib 14 and an oblique side 17 opposite the edge 18 slidably coupled to a correspondingly oblique side 19 of the second profiled elements 7. Between the conjugated surfaces defined by the oblique sides 17, 19 there is interposed a second sliding pad 20.

Further, each second profiled element 7 has a further right edge that is coupled by means of a third slicing pad 21 with the respective chamber 12, 13 in a zone diagonally opposite the first sliding pad 16.

The invention claimed is:

1. Fork-lift attachment comprising:

a frame;

a pair of external forks and a pair of internal forks, each of said pairs of forks being movable from an extended position further from said frame to a retracted position nearer said frame, and vice versa;

first profiled elements to support said pair of external forks;

second profiled elements to support said pair of internal forks; and said frame comprising a guide device to guide said first profiled elements and said second profiled elements, said guide device receiving both said first profiled elements and said second profiled elements, said first profiled elements and said second profiled elements being contained inside chambers of said guide device, each chamber having a first angular zone slidingly coupled with an edge of a respective first profiled element and a second angular zone slidingly coupled with an edge of a respective second profiled element; said respective first profiled element having a sliding surface slidably coupled to a conjugated surface of said respective second profiled element.

2. Apparatus according to claim 1, wherein said guide device has a rib interposed between said chambers.

3. Apparatus according to claim 2, wherein each first angular zone is near said rib.

4. Apparatus according to claim 1, wherein said second angular zone is diagonally opposite said first angular zone.

5. Apparatus according to claim 1, wherein said chambers longitudinally occupy crosspiece elements of said guide device.

6. Apparatus according to claim 1, wherein said first profiled elements and said second profiled elements have respective cross sections conjugated to each chamber of said chambers.

7. Apparatus according to claim 1, wherein a sliding pad is interposed between said sliding surface and conjugated surface.

8. Apparatus according to claim 7, wherein both said sliding surface and conjugated surface are oblique.

9. Apparatus according to claim 1, wherein both said sliding surface and conjugated surface are oblique.

* * * * *